US006269843B1

(12) United States Patent
Bertolone

(10) Patent No.: US 6,269,843 B1
(45) Date of Patent: Aug. 7, 2001

(54) RADIAL AND FLEXIBLE ANNULAR STORAGE DRUM BRAKE

(75) Inventor: Roberto Bertolone, Ponzone Biellese (IT)

(73) Assignee: Nuova Roj Electrotex S.R.L., Biella (IT)

( * ) Notice: Subject to any disclaimer, the term of this patent is extended or adjusted under 35 U.S.C. 154(b) by 0 days.

(21) Appl. No.: 09/529,615

(22) PCT Filed: Oct. 15, 1998

(86) PCT No.: PCT/EP98/06531

§ 371 Date: Apr. 17, 2000

§ 102(e) Date: Apr. 17, 2000

(87) PCT Pub. No.: WO99/20557

PCT Pub. Date: Apr. 29, 1999

(30) Foreign Application Priority Data

Oct. 15, 1997 (IT) ..... MI97A2327

(51) Int. Cl.[7] ..... B65H 51/22; D03D 47/34
(52) U.S. Cl. ..... 139/452; 242/365.4
(58) Field of Search ..... 139/452; 242/365.4

(56) References Cited

U.S. PATENT DOCUMENTS 3,995,786 * 12/1976 Deniega ..... 139/452
4,926,912 5/1990 Zenoni .
5,577,536 * 11/1996 Maina ..... 139/452
5,715,871 * 2/1998 Covelli et al. ..... 139/452

FOREIGN PATENT DOCUMENTS 0 534 263 3/1993 (EP) .
0 686 128 12/1995 (EP) .
WO 94/10075 5/1994 (WO) .
WO 95/00431 1/1995 (WO) .

* cited by examiner

*Primary Examiner*—Andy Falik
(74) *Attorney, Agent, or Firm*—Young & Thompson

(57) ABSTRACT

In a yarn braking device (B) of a yarn feeder (F) for looms—of the type comprising an annular brake element (E) having a substantially conical and circumferentially continuous braking portion (P), of which at least the radial flexibility is significant and which is positioned coaxial to a body shaped as a drum (4), around which is wound a weft yarn reserve, under an axial spring load (K) and in peripheral contact, along an essentially circular braking zone (Z), with a rim (W) of said drum (4) from which the yarn (Y) is withdrawn, and a flexible and wearproof friction surface structure (S) provided on said braking portion (P) in said braking zone (Z)—said friction surface structure (S) is formed by a plurality of separate elements (C) contacting said braking portion (P) in said braking zone (Z) and movable one in respect of the other.

15 Claims, 3 Drawing Sheets

FIG.1
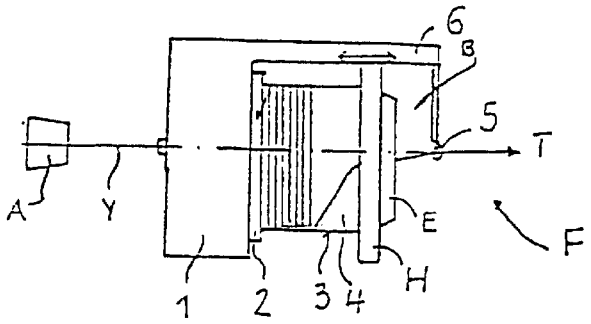
FIG.2
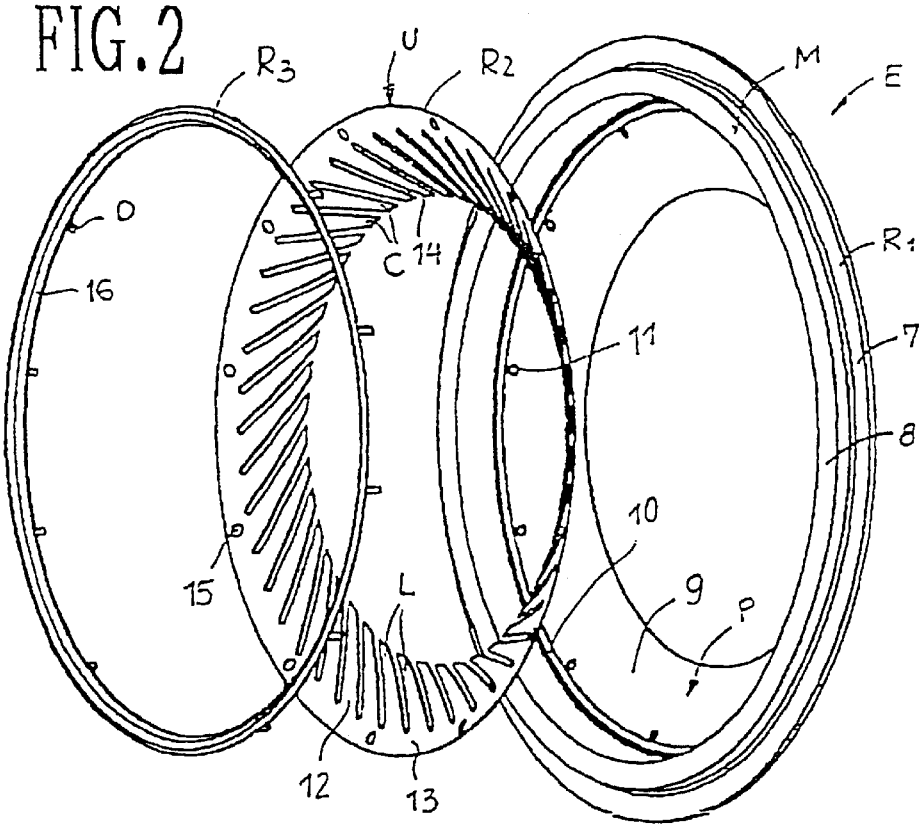
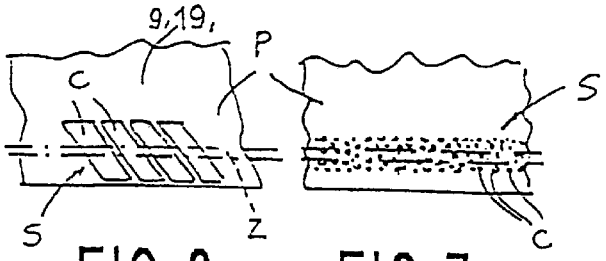
FIG.6 FIG.7

RADIAL AND FLEXIBLE ANNULAR STORAGE DRUM BRAKE

BACKGROUND OF THE INVENTION

The present invention relates to a yarn braking device in yarn feeders and to an annular brake element for said device.

DESCRIPTION OF THE RELATED ART

Yarn braking devices, as disclosed in EP-A-0 686 128 and EP-A-0 534 263, are equipped on the inner side of the braking portion of the brake element with a circumferentially continuous lining, or metallic layer, defining a frustoconical brake band. Yarn braking devices of this type guarantee a self-adjusting or self-compensating effect, i.e., they automatically reduce the braking effect as yarn speed increases, and viceversa, so as to achieve a tension profile in the yarn being withdrawn which has only small fluctuations, i.e., a relatively constant yarn tension level.

In a yarn braking device as disclosed in U.S. Pat. No. 4,926,912, individually bendable laminae, interconnected by a circumferentially extending base section of the annular brake element, are used to directly transmit the axial load of the brake element onto the withdrawal rim of the yarn storage drum, and on the yarn itself. The withdrawn yarn, unwinding along the withdrawal rim, subsequently lifts the various laminae and becomes tensioned. An increase in the withdrawal speed hence leads to a progressive increase of the yarn tension, and the yarn braking device is thus unable to accomplish a self-adjusting or self-compensating braking effect.

BRIEF SUMMARY OF THE INVENTION

The object of the invention is to provide a yarn braking device and an annular brake element of the type described heretofore, having a self-adjusting or self-compensating effect and an improved operating behavior resulting into a highly reduced number of operating inconveniences, particularly of yarn breakages.

According to the invention, said object is reached with a yarn braking device having the characteristics disclosed in a first embodiment, and with an annular brake element as in a second embodiment.

According to the first embodiment, said yarn braking device essentially comprises an annular brake element having a substantially conical and circumferentially continuous braking portion, of which at least the radial flexibility is significant and which is positioned coaxial to a body shaped as a drum around which is wound a weft yarn reserve under an axial spring load and in peripheral contact, along an essentially circular braking zone, with a rim of said drum from which the yarn is withdrawn, and a flexible and wearproof friction surface structure provided on said braking portion in said braking zone, and is characterized in that said friction surface structure is formed by a plurality of separate elements contacting said braking portion in said braking zone and movable one in respect of the other.

Since separate elements, positioned along said braking zone, are used to transmit the forces between the braking portion and the yarn withdrawal rim, or the yarn respectively, said separate elements being movable in relation to each other and being backed-up by the braking portion, it is not possible for such elements to accomplish a significant spring action or deformation resistance, apt to interfere with the mutual cooperation between the braking portion and the yarn withdrawal rim, or the yarn respectively. In fact, the separate elements behave extremely passively and do not undesirably disturb the constant and smooth transmission of forces between the braking portion, and the yarn withdrawal rim and the yarn. The separate elements merely fulfil the task of providing a predetermined coefficient of friction and an effective wear protection for the braking portion. Failing, therefore, a circumferentially continuous structure with undesirable spring properties and deformation resistance, it is possible to obtain a performance of the braking device similar to that which would be obtained if the radially flexible braking portion were in direct contact with the yarn withdrawal rim, and with the yarn. Even at high speeds, in modern projectile or gripper looms, and with delicate yarn qualities, it is possible to obtain an efficient self-adjustment or self-compensation of the braking effect, which results into a significantly reduced number of operating inconveniences, such as yarn breakages. For example, a coarse denim yarn can be safely woven with a yarn feeder and a gripper loom working at high speed.

According to another embodiment, all said separate elements are movably interconnected within a unitary body. This of course simplifies securing the elements to the braking portion, which must be done in such a way that, in the braking zone, said elements are separated one from the other.

According to another embodiment, said separate elements are not totally interconnected, but are secured to the braking portion one by one. They anyhow provide the required wear resistance and friction coefficient and are apt to prevent the braking portion from contacting the yarn, but do not have any disturbing effect on the mutual cooperation between the braking portion and the yarn. Said elements might even be secured to the braking portion in the braking zone, i.e., directly behind the braking zone.

According to another embodiment, the separate elements are easy to manufacture and have a long-lasting operation, a high wear-resistance and a uniform passive behavior. A solution fo the present invention could also be to adopt a light braking body comprising laminae and to support such laminae at the back—when they are lifted by the yarn unwound in "defile" along a spiral-shaped path—at least on the braking zone, by means of a circumferentially continuous, flexible and pre-loaded braking portion, acting as backup member.

According to another embodiment, the laminae could be positioned in an essentially radial direction, if wishing to operate in both rotation senses of the yarn feeder. If the laminae are positioned obliquely in respect of a radial direction, they can be used to operate only in one rotation sense, i.e., in the sense in which the laminae are inclined.

In another embodiment, a single unitary strip with a base section connecting the laminae, is advantageous from a manufacturing point of view. The base section connecting the laminae is of course positioned at a distance from the braking zone and has no negative effects on the passive flexibility and relative mobility of said laminae. The main purpose of the base section is to keep the laminae in a predetermined positioning, for instance with small interspaces in which the yarn cannot touch the braking portion supporting them at the back.

According to another embodiment, the single unitary strip is manufactured in a flat condition, the laminae are formed by cutting interspaces therein, and the strip is subsequently bent into the shape corresponding to the shape of the braking portion in operating conditions.

Another embodiment provides for a relatively large number of laminae, which is advantageous for their extreme flexibility and passive behavior during operation of the device.

According to yet another embodiment, the braking portion extends close to the free tips of the laminae, which is even more advantageous in order to support said laminae over the full length thereof. It is important for the braking portion to support the laminae at the back, at least behind the braking zone, so that said laminae do not behave as active springs. An extension of the braking portion beyond the free tips of the laminae might be advantageous to prevent an undesired contact of the withdrawn yarn with said free tips.

According to another embodiment, said separate elements are particles applied onto the braking portion, in the braking zone. Said separate elements may define an almost continuous surface, but are nevertheless movable in respect of each other so as not to determine an undesirable spring behavior or resistance to deformation in the mutual cooperation between the yarn and the flexible braking portion.

According to another embodiment, the braking portion is part of an essentially annular elastic membrane apt to transmit the required forces, uniformly and smoothly, onto the yarn withdrawal rim and onto the yarn, and also to take up the counterforces of the yarn moving along a spiral-shaped path. The brake element is easy to manufacture and to mount, and leads to a uniform, long-lasting and reliable operation.

According to another embodiment, the braking portion does not release the axial spring load directly onto the yarn withdrawal rim and onto the yarn, while it simultaneously takes up the counterforce of the yarn by elastic deformation. Due to the intrinsic elastic properties of the membrane, no additional spring means are required to generate the axial spring load. By adjusting the axial position of the support in respect of the yarn storage drum, or of its yarn withdrawal rim, the strength of the axial spring load can be easily and gradually varied, resulting into a precisely adjustable braking effect.

In another embodiment, the brake element is a frustoconical structure made, for example, of carbon fibers embedded in or coated with plastic material (strengthened fabric). Said brake element achieves a significant axial rigidity to release the axial spring load with minimum losses, a significant radial flexibility to allow a uniform braking effect, and a considerably low inertia leading to an excellent operation, even with drastic speed changes and for a great variety of different yarn qualities.

According to another embodiment, said frustoconical structure is supported, either at its end of wider diameter or at its end of smaller diameter, by a stationary holder. The axial spring load is generated by spring means provided between said holder and said frustoconical structure. This leads to a perfect self-centering behavior of the brake element in operation, and allows to precisely adjust the braking action by adjusting the axial position of the holder in respect of the yarn withdrawal rim. The frustoconical structure can be pulled or pressed in respect of the withdrawal rim of the yarn storage drum.

According to another embodiment, a reliable bonding of the unitary body of separate elements to the brake element is provided for. The bonding area can be of circular shape coaxial to the braking zone, but also outside or inside the braking zone, to ensure the relative mobility between the separate elements in the braking zone.

Alternatively, according to another embodiment, the unitary body of separate elements is secured to the brake element by mechanical fixing means. This could be advantageous from the manufacturing point of view and as far as reliability. Furthermore, said mechanical fixing means can be used to secure the unitary body in a removable manner. This allows to replace said unitary body without having to replace the brake element, for example if having to adapt the yarn braking device to specific yarn qualities and special rotation directions (S or Z), for maintenance purposes or for replacement, for instance due to wear.

According to another embodiment, the mechanical fixing means are already provided in the brake element. Different unitary bodies with separate elements can be inserted in an interchangeable manner. The pocket, or the clamps, are merely meant to set the position of the unitary body in respect of the brake element, and are of scarce importance during operation of the device since the mutual contact between the separate elements and the braking portion is then sufficient to suitably position the unitary body.

According to the second embodiment, the annular brake element of the present invention comprises a substantially conical and circumferentially continuous braking portion, of which at least the radial flexibility is significant and which has a flexible and wearproof friction surface structure extending circumferentially and coaxially along said braking portion, and is characterized in that said friction surface structure is formed by a plurality of separate elements, which are movable one in respect of the other and each of which moves into contact with said braking portion.

The annular brake element according to the second embodiment is easy to manufacture and can be used as a spare part fitting onto already existing brake devices.

Some embodiments of the present invention will now be described, by way of example, with reference to the accompanying drawings, in which:

BRIEF DESCRIPTION OF THE DRAWINGS

FIG. 1 is a very diagrammatic side view of a yarn feeder;

FIG. 2 is an exploded view of a brake element for a yarn feeder as shown in FIG. 1;

FIGS. 6 and 7 show two variants of a detail of a brake element according to the invention.

DETAILED DESCRIPTION OF THE INVENTION

Figure 3:
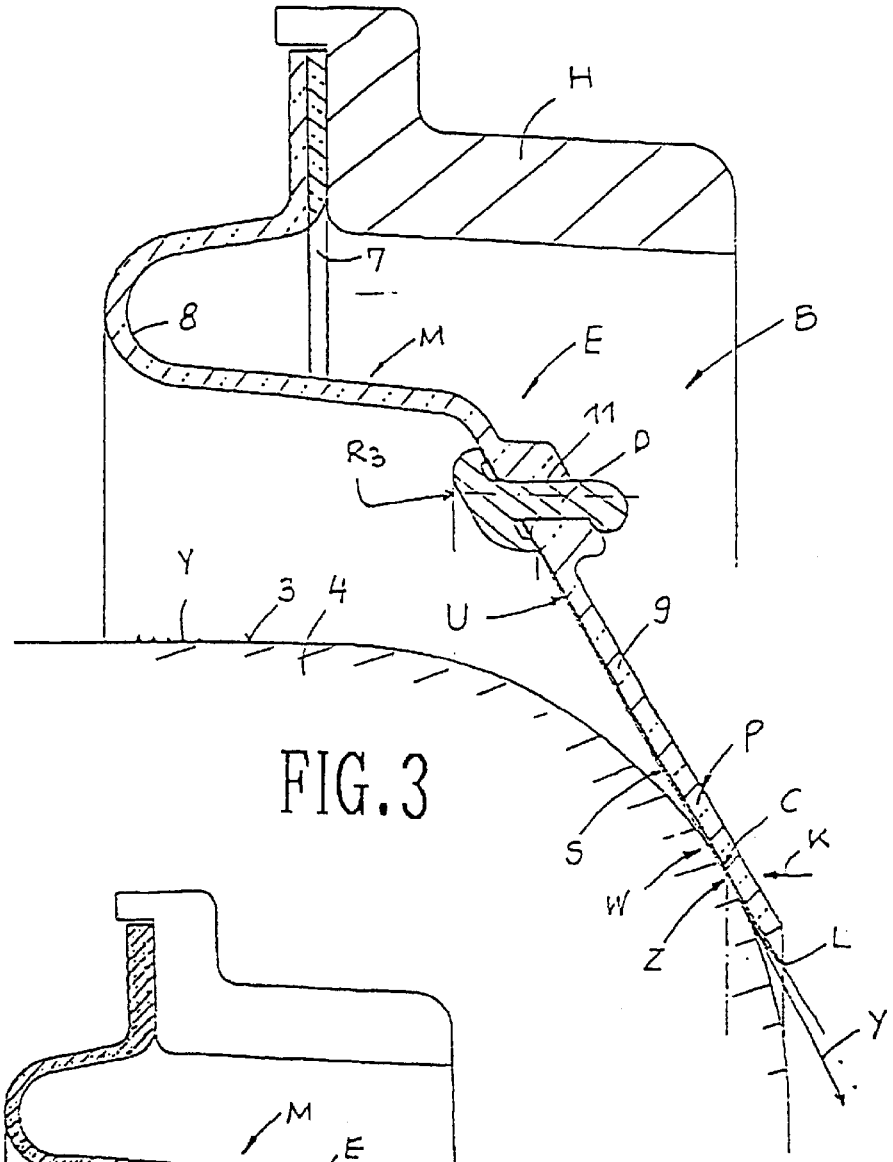
FIG. 3 is a longitudinal section view, on an enlarged scale, of one half of a yarn braking device according to a first embodiment of the present invention.

FIG. 1 shows a yarn feeder F, meant to unwind a yarn Y from a spool A, so as to form a yarn reserve to be stored on the surface 3 of a body shaped as a drum 4, and allow the intermittent withdrawal of yarn Y by a textile machine T, for example a gripper or projectile loom. In the housing 1 of the feeder F, a rotatable element 2 is driven into rotation by a motor (not shown) in order to perform successive windings of yarn Y around the drum 4. In the front end zone of the drum 4 an arm 6, forming part of the housing 1, supports a yarn braking device B cooperating with the front end of the drum 4. The yarn braking device B comprises a stationary holder H, also supported by the arm 6 in order to be able to adjust its position along the axis of the drum 4, and an annular brake element E supported by said holder H. The yarn Y, withdrawn through the yarn braking device B downstream of the drum 4 around which is wound the yarn reserve, slides through an outlet yarn guide eyelet 5 and is drawn and used by the textile machine T.

In the embodiment shown in FIG. 2, the brake element E consists of three ring-shaped components R1, R2, R3. The component R1 is an annular frustoconical membrane M of elastic material, as rubber, foam plastic, or rubber-like plastic material. Preferably, for the membrane M use can be made of an age-resistant plastic material, for instance of the type sold under the registered trademark DESMOPAN. At the end of wider diameter of the membrane M, a stiff ring-shaped portion 7 is applied to allow mounting the brake element E onto the holder H. As shown in further detail in the longitudinal section view of FIG. 3, the membrane M extends outwardly towards the yarn feeder F with at least one circumferential wave portion 8—advantageous to give spring and/or self-centering properties to the brake element E—and terminates inwardly with a generally frustoconical wall section 9 which defines the braking portion P. The wall thickness of the membrane M can be uniform, but not necessarily. A seat 10 and fixing holes 11 can also be formed into the membrane M (which can be a single molded piece).

The ring-shaped component R2 is a unitary body U formed of a plurality of frustoconical elements made, for example, from thin sheet metal. Their thickness may vary from 0.01 to 0.5 mm, and preferably from 0.05 to 0.15 mm. The unitary body U may be a one-piece endless structure, or it can be obtained by bending a flat strip (FIG. 5) into the shown configuration. A plurality of inclined laminae L, with small interspaces 14 between them, project from an outer circumferentially continuous base section 13 of the body U. Fixing holes 15 can be provided in the base section 13.

In a preferred embodiment of the invention, for a braking zone Z having a diameter of about 120 mm, the thickness of the unitary body U can be of 0.08 mm, the width of each lamina L can be about 1.5 mm, the interspaces 14 between said laminae can be about 0.1 mm, and the free length of the laminae L can be about 15 mm.

The ring-shaped component R3 is a mechanical fixing member allowing to apply the unitary body U onto the membrane M. Said ring-shaped component may consist of a molded plastic portion 16, with mechanical fixing elements D engaging into the holes 15 and 11. Instead of the mechanical fixing elements D incorporated into the portion 16, a plurality of separate fixing elements D can be adopted.

FIG. 3 illustrates the brake element E in its assembled condition and installed for operation. The membrane M is supported, through its stiff ring-shaped portion 7, by the stationary holder H, in a position adjustable along the axis of the yarn storage drum 4, so that the braking portion P may be axially pressed against the front end of said drum 4 with a preset spring load K. The unitary body U is secured to the membrane M by the fixing elements D so that, when said body U is pressed by the braking portion P against the drum 4, the laminae L may get in contact with the outlet rim W of said drum for yarn withdrawal in an essentially circular braking zone Z. The laminae L, being separated in the braking zone Z by the interspaces 14, are apt to move in relation to each other according to the deformations of the braking portion P. Preferably, the braking portion P is in contact with the laminae L without being connected thereto, and preferably over almost their full length. It can be of particular importance that, in the braking zone Z, the laminae L may moreover be apt to move in respect of the braking portion P. However, according to another embodiment of the invention, it is also possible to secure the laminae L to the braking portion P even in correspondence of the braking zone Z. The laminae L form in their whole a friction surface structure S on the braking portion P, for the yarn Y drawn through the braking zone Z while simultaneously being braked. The outlet angle of the yarn Y, on its path towards the yarn guide eyelet 5, is preferably more inclined than the braking portion P, so as to avoid contact between the yarn itself and the free tips of the laminae L. The laminae L define separate elements C, the purpose of which is to provide a good wear resistance and a predetermined coefficient of friction for the yarn Y in the braking zone Z. The laminae L, being parted and flexible in the braking zone Z, tend to behave passively to the respective forces being transmitted from the braking portion P onto the yarn Y and viceversa. The further is the position of the holder H adjusted towards the feeder drum 4, the stronger becomes the braking effect. The yarn Y, being unwound "in defile" around the withdrawal rim W in the braking zone Z, continuously deforms the braking portion P and is braked. The working of the yarn braking device B merely depends on the cooperation between the braking portion P and the yarn Y, and is not detrimentally influenced by the presence of the separate elements C, defined in this case by the laminae L. In operation, the laminae L behave extremely passively to the mutual forces transmitted between the braking portion P and the yarn Y, while simultaneously defining a predetermined coefficient of friction and providing a high resistance to wear; they moreover protect the braking portion P against wear due to abrasion determined by yarn passage.

Figure 4:
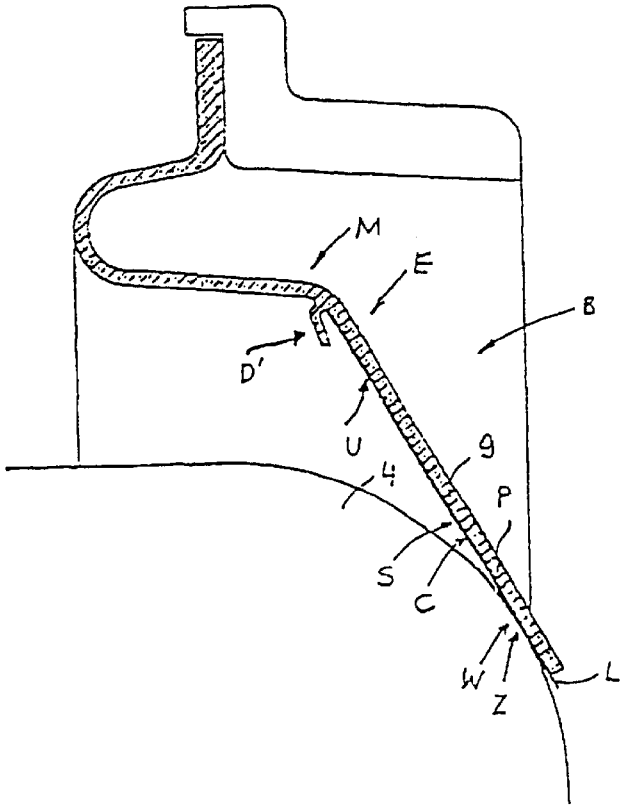
FIG. 4 is a longitudinal section view of another embodiment of said yarn braking device.

In the embodiment shown in FIG. 4, the membrane M is provided with a circular pocket D' or with different circumferentially distributed clamping means (not shown), to retain the unitary body U in a removable manner, so that it may be supported at the back by the braking portion P in its contact with the yarn withdrawal rim W in the braking zone Z. In the embodiments of FIGS. 3 and 4, the braking portion P terminates within the free tips of the laminae L. However, the braking portion P may also extend as far as the free tips of the laminae L, or even beyond said free tips, in order to create a protective guiding edge of the yarn Y being withdrawn, in case of unintentional contacts. Though not shown on the drawings, the unitary body U could also be bonded by glueing in a circular area or bonded spot-wise directly onto the membrane M, or the braking portion P respectively. In this case, when replacement is required, the whole brake element E needs to be replaced.

Figure 5:
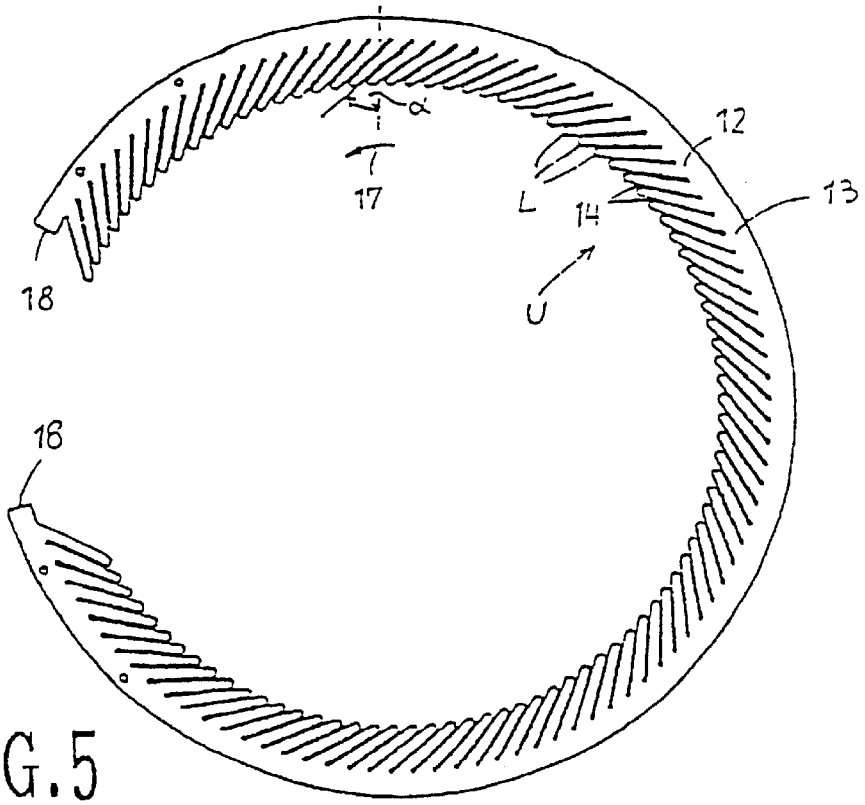
FIG. 5 is a front view of a unitary body with separate elements, prior to its mounting onto the yarn braking device according to the invention.
Figure 8:
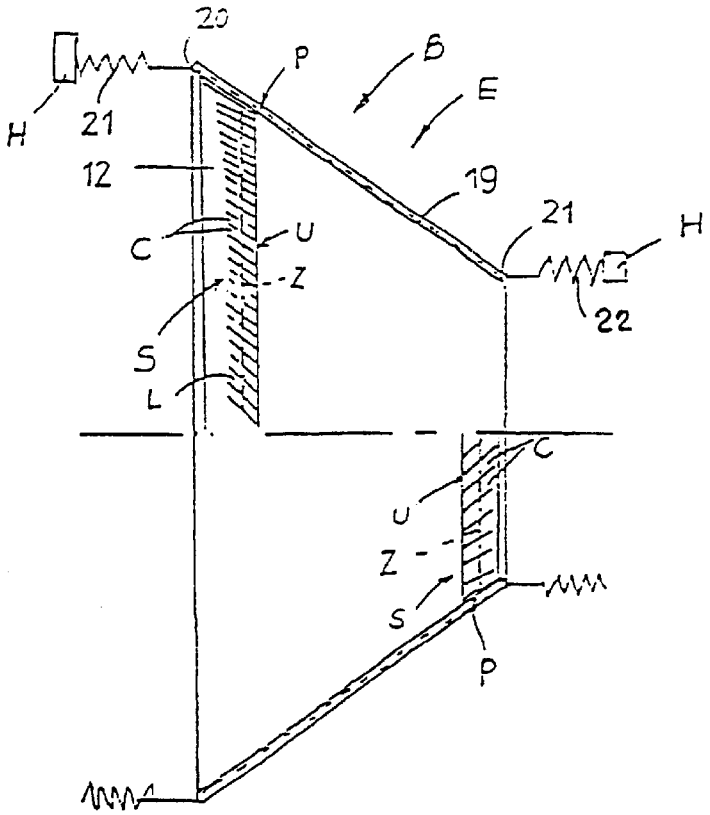
FIG. 8 is a diagrammatic longitudinal section view of a further embodiment of the yarn braking device according to the present invention.

In the embodiment shown in FIG. 5, the unitary body U consists of a strip 12 of laminae L, produced flat and having a continuous outer base section 13 from which inwardly project the laminae L. Before applying said unitary body U onto the brake element E, the ends 18 of the strip 12 are spaced apart. Subsequently, by joining the ends 18, the strip 12 of laminae L takes up a frustoconical configuration, as shown for example in FIGS. 2 and 3. In FIG. 5 the laminae L are inclined, in respect of a radial positioning, by an angle $\alpha$ included between 10° and 70°. However, the laminae L can also be radially positioned. The inclination shown in FIG. 5 allows to use the strip of laminae L only in one sense of rotation of the yarn Y being withdrawn along the rim W, namely in the direction of arrow 17. The unitary body U can be easily replaced by disengaging the mechanical fixing elements D, without having to replace the membrane M.

The embodiment of FIG. 6 provides for separate elements C, apt to fully define the friction surface structure S on the braking portion P in the braking zone Z. Such elements C, instead of being interconnected—as in FIGS. 2 to 5—by a base section 13, are fully parted and the base section is totally absent. The elements C are flexible, wearproof, and are apt to protect the braking portion P from direct contact with the yarn Y. Furthermore, they define a predetermined coefficient of friction for the yarn Y. The separate elements C can be bonded, for instance by glueing, onto the braking portion P, either with one of their ends or throughout their length.

In the embodiment of FIG. 7, the elements C consist of a plurality of particles of a wearproof material bonded to the braking portion P, at least in the braking zone Z, either by glueing or by spraying.

The braking zone Z is a circle line only in theory, as in practice it might have a certain extension in width. In each of the embodiments, the elements C should cover an area of the braking portion P extending to a certain width, in order to make sure that the yarn Y will always and only get in contact with the friction surface structure S.

In the alternative embodiment of FIG. 5, the brake element E of the yarn braking device B consists of a frustoconical structure 19, made of a high-strength fibrous material containing, for example, carbon fibers and plastic material (fiber reinforced fabric). The braking portion P is positioned either close to the end of wider diameter 20 or close to the end of smaller diameter 21 of the frustoconical structure 19. The structure 19 has a significant radial flexibility, a considerable axial rigidity and an extremely low inertia. The friction surface structure S is provided either close to the end of wider diameter 20 or close to the end of smaller diameter 21 of said frustoconical structure 19, on the inner surface of the respective braking portion P, and it is defined by separate elements C at least in the braking zone Z. Preferably, the elements C are mutually connected outside the braking zone Z by a base section 13, as shown in FIG. 5. The separate elements C may consist of laminae L, as shown in FIG. 5 or of particles as shown in FIG. 7. Even fully parted elements C could be used, as shown in FIG. 6, at least partly bonded to the inner side of the braking portion P. The axial spring load (K), required for the brake element E, is generated by spring means 21 provided between the stationary holder H and the frustoconical structure 19.

What is claimed is:

1. Yarn braking device of a weft feeder, comprising:

an annular brake element having a substantially conical, circumferentially continuous braking portion, a drum-shaped yarn storing body constituting a circumferentially continuous and circular yarn withdrawal rim, said annular brake element being located coaxial to said yarn storing body, said braking portion abuts said withdrawal rim under axial spring load, pressing said braking portion towards said withdrawal rim, said braking portion being radially flexible, and a flexible, wear resistant friction surface structure provided between said braking portion and said withdrawal rim and held in circumferential contact along an essentially circular braking zone at said withdrawal rim, wherein said friction surface structure is formed by a plurality of flat lamellas separated from each other by interspaces and being movable in relation to one another, each lamella having a front surface contacting said withdrawal rim in said braking zone, and a rear surface opposite to said front surface, said braking portion discretely pressing each lamella directly behind the location of said braking zone against said withdrawal rim.

2. The device of claim 1, wherein said lamellas are of an equal predetermined length, terminate at free lamella tips, and are commonly incorporated in a unitary element body of frustoconical shape, said unitary element body being secured to said braking portion.

3. The device of claim 1, wherein each said lamella is separately secured to said braking portion.

4. The device of claim 1, wherein said lamellas are made of thin walled sheet metal with substantially equal circumferential widths.

5. The device of claim 1, wherein said lamellas are commonly oriented essentially radially or obliquely with respect to a radial orientation.

6. The device of claim 2, wherein said unitary element body consists of a unitary strip having an inner or outer lamella intersecting base section, said unitary strip being pre-manufactured in flat condition and bent to the shape of a frustocone envelope.

7. The device of claim 1, wherein said plurality of lamellas further comprises: about 120 inclined lamellas having interspaces of about 0.1 mm, and having equal widths of approximately 1.5 mm, and having thicknesses between their inner surfaces and their rear surfaces of about 0.01 to 0.5 mm, said lamellas being in a braking zone having a diameter of approximately 120 mm.

8. The device of claim 7, wherein the thickness of said lamellas is between 0.05 to 0.15 mm.

9. The device of claim 1, wherein said braking portion extends over essentially the full length of the lamellas.

10. The device of claim 9, wherein said braking portion extends beyond the free lamella tips.

11. The device of claim 1, wherein said brake element is an essentially annular elastic membrane made of rubber foam material or rubbery plastic material, said membrane being attached at its outer diameter to a rigid holding ring detachably inserted into a stationary holder of said yarn feeder, and said axial spring load is generated by inherent spring properties of said elastic annular membrane.

12. The device of claim 1, wherein said brake element is a frustocone envelope made of high strength fiber and plastic material with high axial rigidity, radial flexibility, and low inertia, and said brake element is supported either at its outer diameter or at its inner diameter by a stationary holder of said yarn feeder for pulling or pushing said braking portion axially against said withdrawal rim, said axial spring load being generated by spring means provided between said holder and said brake element.

13. The device of claim 2, wherein said unitary element body is bonded to said brake element.

14. The device of claim 2, wherein said unitary element body is detachably attached to said brake element.

15. The device of claim 2, wherein said brake element has a circular pocket or a circumferentially distributed retainer detachably holding said unitary element body.

* * * * *